United States Patent [19]

Bolton et al.

[11] 4,326,300

[45] Apr. 27, 1982

[54] BELT PACKAGE WITH TEMPORARILY SECURED DETACHABLE BELT END

[75] Inventors: Deborah A. Bolton, Memphis, Tenn.; Jean E. Schaefer, Cincinnati, Ohio

[73] Assignee: The Buckeye Cellulose Corporation, Cincinnati, Ohio

[21] Appl. No.: 45,157

[22] Filed: Jun. 4, 1979

[51] Int. Cl.[2] ..... A41F 9/00; A41D 13/12

[52] U.S. Cl. ..... 2/114; 2/DIG. 7; 2/311; 2/338

[58] Field of Search ..... 2/114, DIG. 7, 2, 69, 2/83, 113, 311, 321, 338, 76

[56] References Cited

U.S. PATENT DOCUMENTS

| | | | |
|---|---|---|---|
| 2,771,237 | 11/1956 | Philipson . | |
| 3,059,240 | 10/1962 | Johnson | 2/76 |
| 3,359,569 | 12/1967 | Rotanz et al. | 2/114 |
| 3,570,012 | 3/1971 | Winters | 2/114 |
| 3,594,818 | 7/1971 | Planner | 2/114 |
| 3,648,290 | 3/1972 | Hartigan | 2/114 |
| 3,696,443 | 10/1972 | Taylor | 2/DIG. 7 |
| 3,824,625 | 7/1974 | Green | 2/114 |
| 3,987,518 | 10/1976 | Collins | 2/338 |
| 3,988,781 | 11/1976 | Horan | 2/DIG. 7 |
| 4,016,604 | 4/1977 | Welke | 2/DIG. 7 |

*Primary Examiner*—H. Hampton Hunter

*Attorney, Agent, or Firm*—Milton B. Graff, IV; John V. Gorman; Richard C. Witte

[57] ABSTRACT

A belt package for a surgical gown is disclosed in which a belt is fan-folded within a tubular belt support and one belt end is folded over and temporarily attached to the front of the belt support. The folded over belt end includes a line of weakness situated a short distance from the tip of the belt end to form a detachable portion useful in insuring sterility. The belt end is folded over by first folding the detachable portion against the rest of the belt end at a point on the belt near the weakened line but between the line and the point of exit of belt from the belt support. The detachable portion is then folded against the belt support face by a fold in the belt near the point of exit from the belt support. The end is temporarily attached to the belt support at point between the line of weakness and the first fold.

10 Claims, 6 Drawing Figures

BELT PACKAGE WITH TEMPORARILY SECURED DETACHABLE BELT END

TECHNICAL FIELD

This invention relates to belts for sterile operating room garments and, more particularly, to a belt package arrangement adapted to provide a sterile closure means for such garments.

BACKGROUND ART

It is known in the art to retain a folded belt in a package separate from a surgical gown or attached to the gown. Rotanz's U.S. Pat. No. 3,359,569 issued on Dec. 26, 1967 discloses a belt retained by a folded overwrap separate from the surgical gown. On the other hand Hartigan's U.S. Pat. No. 3,648,290 issued on Mar. 14, 1972 teaches a belt package attached to the gown that serves as a belt loop when the belt is in use. In Hartigan the belt ends may be folded back against themselves or against the belt package possibly with one end portion overlapping the other. Hartigan points out that this folding pattern is useful in that it causes the belt end portions to stand out from the gown after the gown has been unfolded and placed on a doctor, presenting tabs available for grasping. U.S. Pat. Nos. 3,594,818 to Planner issued on July 27, 1971 and 3,570,012 to Winters issued on Mar. 16, 1971 also disclose belt packages attached to surgical gowns.

It is known to secure the belt package freely around the folded belt so that the belt is retained only by friction between itself and the package. If a tubular belt package is used as in Hartigan the unfolded belt is permitted to slide through the package so that the belt position can be adjusted around the waist of the doctor. A patent to Johnson (U.S. Pat. No. 3,059,240 issued on Oct. 23, 1962) teaches a cantilevered connection of a belt to a dress to allow vertical adjustment of belt position.

The prior art also discloses means to prevent contamination of the belt during the donning process. For example Hartigan and U.S. Pat. No. 3,987,518 to Collins issued on Oct. 26, 1976 disclose protective covers for a belt end. The protective cover can be grasped to unfold the belt and then removed and disposed of after use. Similarly a patent to Taylor (U.S. Pat. No. 3,696,433 issued on Oct. 10, 1972) teaches a belt end portion grasped by a circulating nurse which is removable due to slits made across the width of the belt.

The prior art does not disclose a means for securing the belt ends in an easily accessible position. Nor does the prior art disclose such a means which also protects a detachable belt end. This disclosure describes a means for securing and folding belt ends so as to overcome these deficiencies in the prior art.

DISCLOSURE OF THE INVENTION

The present invention is a belt package for surgical gown. The package includes a belt having a belt end extending from a belt support, the extremity of said belt end being defined by a transverse region of weakness separable from the belt therealong. The belt end is doubled by folding it back on itself along a fold line extending transversely across the balance of the belt in a position adjacent but spaced from said region of weakness. The doubled portion is folded inwardly to position the extremity, the region of weakness and the distal end of the balance of the belt over an outer face of the package and underlying an adjacent portion of the belt end. The distal end is detachably secured to the outer face of the belt package.

DETAILED DESCRIPTION OF INVENTION

The invention is a belt package for a surgical gown involving a folded belt which is retained within a package having a belt end which extends out of the package and is folded and attached to the front of the pouch or to the other belt. The belt end includes a portion connected to the belt by a line of weakness, which portion can be torn off after being contaminated during belt fastening. The belt end folding and securement is such as to protect the tear-away portion prior to use of the belt package. The attachment of the belt end to the front of the pouch is therefore only temporary, so that the belt can be conveniently freed for use.

Figure 1:
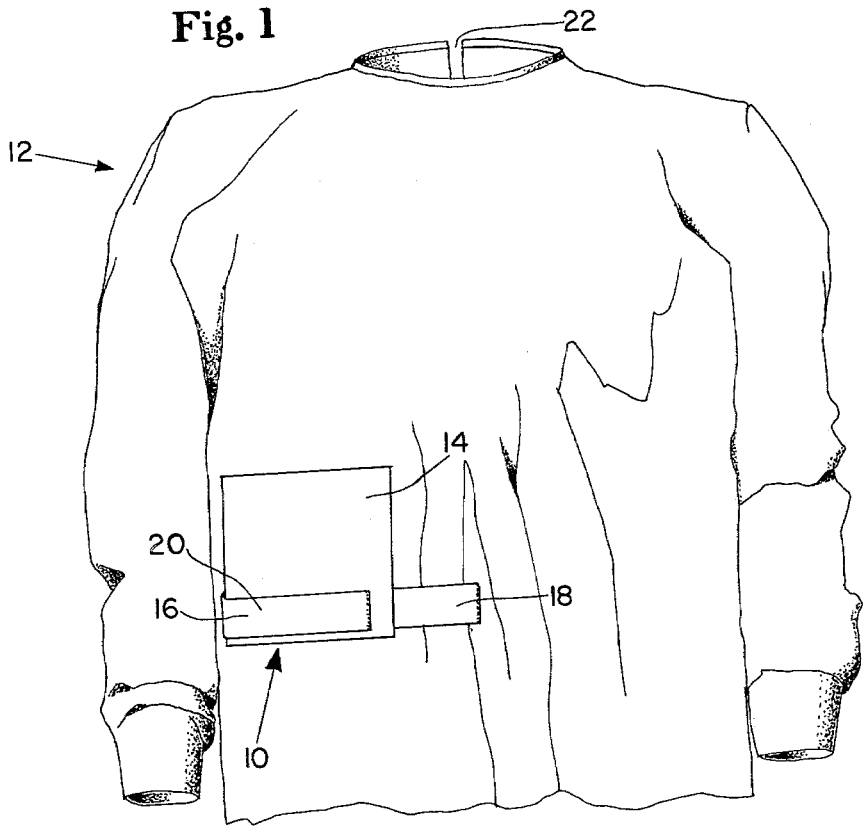
FIG. 1 is a front elevational view showing a preferred embodiment of the belt package of the present invention attached to a surgical gown.

A surgical belt package 10 is shown in FIG. 1 as attached to a surgical gown 12. Package 10 comprises a belt 16, only the ends 18 and 20 of which are visible in FIG. 1, and a belt support 14 which, preferably, includes a tubular enclosure for belt 16. The entire belt package can be made of woven or nonwoven fabric, tissue, tissue laminate, plastic film or film laminate. In a preferred embodiment the material comprises a laminate which is from about 5.5 to 13 mils thick and made of a spunbonded nonwoven fabric central layer surrounded by tissue facing layers as described in U.S. Pat. No. 4,113,911 to Camden and LaFitte issued on Sept. 12, 1978. The surgical gown 12, which normally extends to ankle length, is shown as having a solid front and a rear donning split 22. The package 10 may either be attached to the gown 12 before folding, packaging and sterilizing of the gown, or it may be separately packaged and sterilized and attached to the gown by operating room personnel as desired. The preferred placement of the package on the gown is on the surgeon's right side approximately at waist level.

Figure 2:
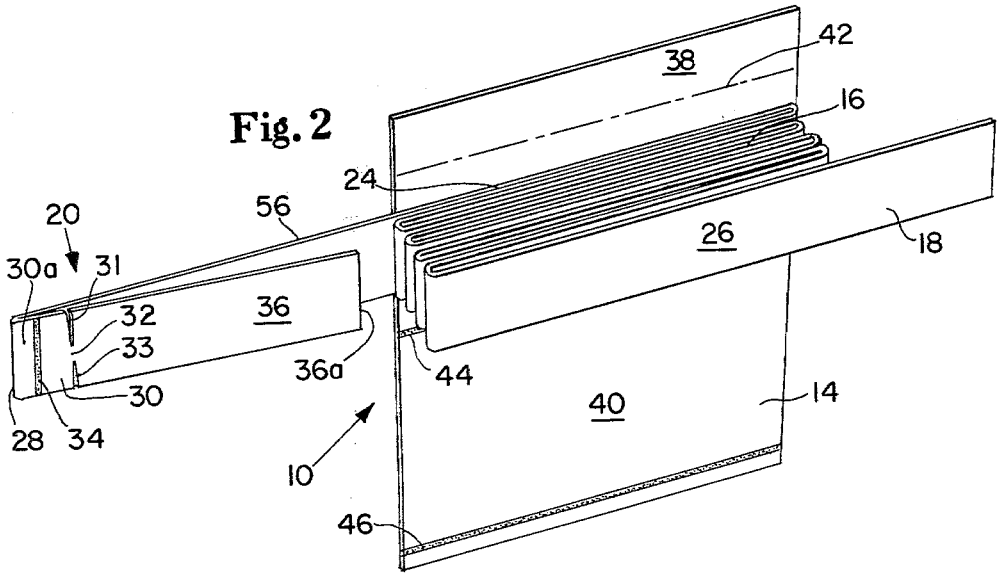
FIG. 2 is a perspective view showing the belt package of FIG. 1 prior to forming the tubular belt support.
Figure 3:
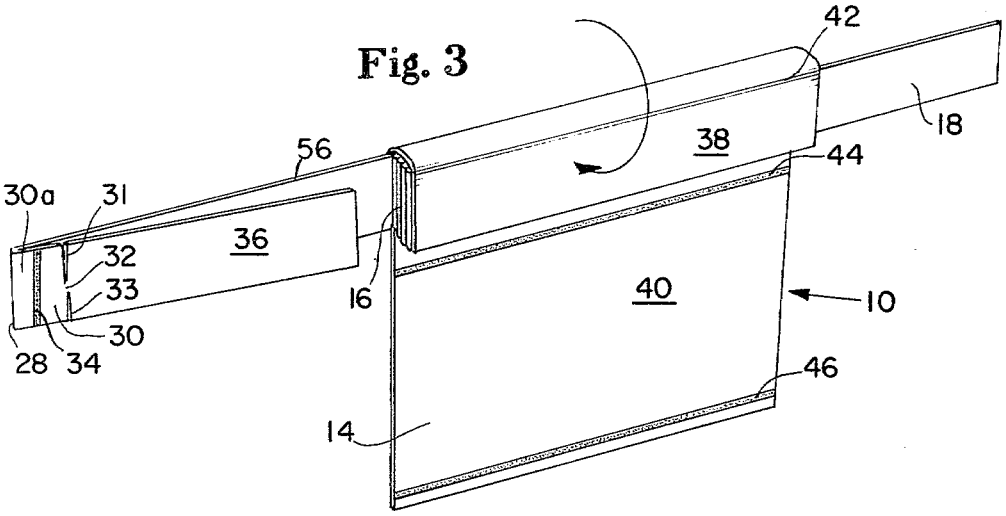
FIG. 3 is a perspective view showing the belt package of FIG. 1 with the tubular belt support partially formed.
Figure 4:
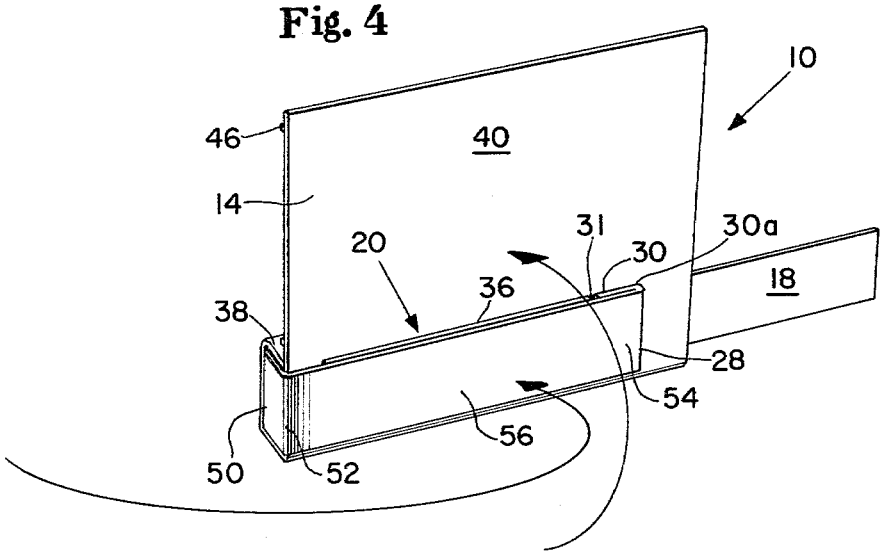
FIG. 4 is a perspective view showing the belt package of FIG. 1 completed.

Elements of the belt package 10 can be seen in FIGS. 2, 3, and 4, which show the steps of assembling the belt package 10. In FIG. 2 the belt package 10 is shown with its belt support 14 unfolded. The belt 16 may be fanfolded with folds approximately equal to the width of the belt support 14, except for folds 26 and 24 containing belt ends 18 and 20, respectively, each belt end 18 or 20 being the portion of the fold 26 or 24 which extends outwardly beyond the side edges of belt support 14. Alternatively, the belt 16 can be folded in other ways, for example, by roll folding or first folding the belt in half and then fan-folding the doubled belt. While in the described embodiment each belt end 18 or 20 extends from the tubular portion of belt support 14 in a different direction, the present invention can be applied to other types of belt packages. It is applicable to any belt package in which a belt end is exposed for convenience in use.

A lower belt fold 24 nearer the gown 12 and including right belt end 20 may be longer than the upper belt fold 26 having left belt end 18. For example, right end 20 may be approximately 28 centimeters in length while length of left end 18 can be about 8 centimeters. Right belt end 20 is doubled, folded back on itself along fold line 28 intermediate of its length, and a line or region of weakness 32 is made across the belt 16 at a location between fold line 28 and the end edge 36*a*. This arrangement defines a tear-away portion or extremity 36 and the distal end 30 (intermediate the fold line 28 and region of weakness 32) of the balance of belt 16.

The belt distal end 30 which is folded back towards belt support 14, has a temporary attachment means 34 on its upper, outer, surface, as shown in FIG. 2. This attachment means 34 extends throughout a region of the surface of distal end 30 and preferably an unattached distal portion 30*a* is created from at least some of that surface adjacent the fold line 28. The portion 30*a* is useful in breaking the temporary attachment means 34, as will be explained in subsequent description. In addition, distal portion 30*a* can function, together with a portion of the belt on the other side of the fold line 28 but adjacent thereto, as a pull tab area, to permit detachment in use. Attachment means 34 can be comprised of adhesive, for example glue or a strip of double-sided adhesive tape; however, the temporary attachment 34 could also be accomplished by equivalent means such as a Velcro fastener, a weakened strip of fabric, or, for example, by heat, pressure, or autogenous sealing or a combination of heat, pressure and natural attraction. The attachment means may be a spot, a series of spots in any arrangement, or a strip across the width of the belt 16. Alternatively, the attachment means may initially be applied to the surface to which the distal end 30 is to be temporarily attached, as will be understood from the subsequent description.

The tear-away extremity 36 is separable from the balance of the belt 16 by breaking the belt along region of weakness 32. In the preferred embodiment the extremity 36 is about 11 centimeters long. As shown, the region of weakness 32 preferably comprises two aligned, spaced slits 31 and 33 extending perpendicularly from each belt edge. Alternatively, the region of weakness 32 can be made by perforating across the width of the belt, or by thermally or chemically degrading the belt material at 32, or by scoring the material at 32. Another variation, known to those skilled in the art, would be to have only a frictional connection between the distal end 30 and the extremity 36. This can be achieved, for example, by using a tubular sheath which envelops the belt end, and is temporarily attached solely by friction, or by light adhesive, or, if a plastic material is used, by application of heat or pressure or a combination of heat and pressure. Such a sheath is disclosed in U.S. Pat. No. 3,987,578 to Collins issued on Oct. 26, 1976, hereby expressly incorporated by reference.

In its preferred form belt 16 is 178 centimeters long and has a width of about 4 centimeters while the belt support 14 is approximately 22 centimeters in length by 15 centimeters in width. As shown in FIG. 2, the belt 16 is fan-folded four times and freely positioned on the belt support 14, leaving an enveloping portion 38 on one side and a suspending portion 40 on the other side. The enveloping portion 38 has a height sufficient to cover the outer face of the folded belt. The suspending portion 40 is adapted to complete the enclosure and serve as the means for fastening the belt to the surgical gown. In the preferred form of this invention the enveloping portion 38 is about 4 centimeters long while the suspending portion 40 is about 14 centimeters long.

FIG. 3 illustrates the folding of the enveloping portion 38 atop the folded belt 16 by folding portion 38 along side the edge of belt fold 24 and along fold line 42. The suspending portion 40 is then folded upwardly over the enveloping portion 38. The suspending portion 40 preferably has two stripes of adhesive 44 and 46 extending thereacross parallel to folded belt 16. Pouch securing stripe 44 is positioned about 1.6 centimeters from the folded belt 16 and stripe 46 is adjacent the free end of portion 40 and adapted to fasten the belt package 10 to gown 12. The adhesive stripes 44 and 46 can comprise a heat activatible adhesive such as ethylene vinyl acetate (EVA) or, if desired, an alternative means known to those skilled in the art, such as latex adhesive. When the suspending portion 40 is folded atop the portion 38, the adhesive stripe 44 attaches to the enveloping portion 38 at a point below the center line of the folded belt 16 to form a tubular enclosure surrounding the folded belt 16 and a height adjustment/suspending strip comprising the suspending portion 40 between the stripe 44 and its distal end.

Finally, as shown in FIG. 4, the doubled portion of the right belt end 20 is folded inwardly against that part of the suspending portion 40 overlying fold 26 of folded belt 16 by means of a transverse fold line 50 located in the region where the belt end 20 exits from the support 14 and by transverse fold line 52 at the right front corner of the belt package 10. The belt end 20 is attached to suspending portion 40 by temporary attachment means 34 shown in FIGS. 2 and 3. Preferably an unattached distal portion 30*a* and a pull tab 54 are created by spacing the temporary attachment means 34 a short distance from the fold line 28, thus leaving portion 30*a* free of attachment. This distance is preferably about 1.6 centimeters. The belt package is then appropriately attached to the gown 12 by a gown attachment means in the form of stripe 46.

The device operates in the following manner. The surgeon breaks the temporary attachment 34 of the belt end 20 by grasping, between the right thumb and right index finger, the fold 56 which runs from fold line 52 to fold line 28 and pulling it outwardly. The physician's insertion of one or more fingers between the fold 56 and the extremity 36 is facilitated by the unattached distal portion 30*a* which provides the slack needed to allow the fold 56 to outwardly expand away from the extremity 36. Alternatively, pull tab 54 may be used. Then the surgeon grasps the tab 54 between the thumb and forefinger of the right hand and pulls it, breaking the temporary attachment of the belt end 20 to the belt support 14 created by attachment means 34. In either case, if the temporary attachment means 34 is adhesive or double-sided tape, and if the package surface is made of fibrous material, fiber tear will occur during detachment and some fibers will continue to adhere to the disconnected side of the adhesive or tape after the attachment is broken, effectively neutralizing any sticky residue. The surgeon then extends his or her arm to the right so that the belt 16 is fed out of the package 10 fold by fold. The natural effect of the surgeon's motion is to rotate the extremity 36 and thus to present the extremity 36 to a circulating or scrub nurse, standing behind the surgeon, who grasps the extremity 36 and brings it around the surgeon's back and over to the left side. The surgeon then grasps the fold 56 and pulls it, breaking the belt 16 along region of weakness 32 and leaving the circulating nurse with the separated, contaminated, extremity 36. By pulling on the left belt end 18 the surgeon can pull the remainder of belt 16 out of the package to allow him or her to tie the belt on the left side. Alternatively the tying operation can be conducted by one scrub nurse and one circulating nurse without assistance from the surgeon.

The position of the belt 16 can be vertically and horizontally adjusted on the surgeon. The distal end of the suspending portion 40, i.e., that between stripes 44 and 46, allows the belt to be vertically adjusted on the gown 12 with the enveloping portion 38 serving as a belt loop. In addition the belt 16 is free to move horizontally through the enveloping portion 38 in either direction. This allows the tied belt ends 18 and 20 to be positioned at any desired point around the waist of the surgeon.

Figure 6:
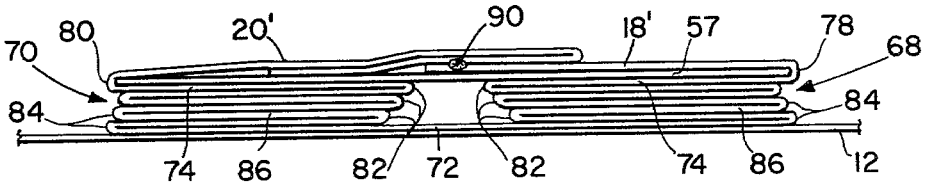
FIG. 6 is a cross-sectional view of the belt package of FIG. 5, taken along line 6—6.
Figure 5:
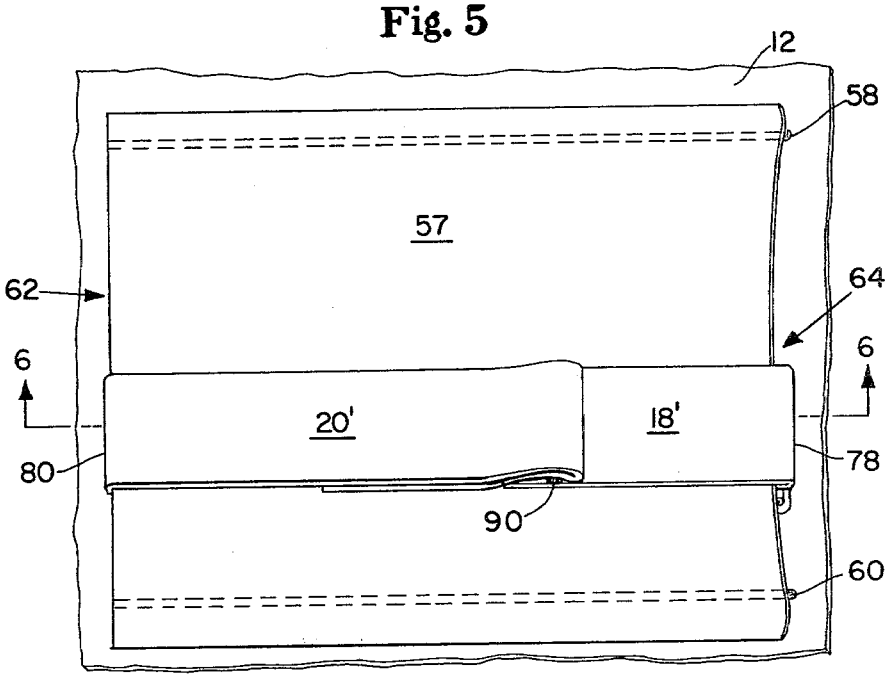
FIG. 5 is a fragmentary perspective view showing another preferred embodiment of a belt package of the present invention, utilizing a different belt folding scheme.

The construction of the belt support 14 can be varied without departing from this invention. FIGS. 5 and 6 show a patch-type belt support 57. In the patch-type belt support 57 a rectangular sheet of material is attached to the gown by two stripes of adhesive 58 and 60 leaving lateral exit orifices 62 and 64 through which belt ends 18' and 20' may exit. Each stripe of adhesive is applied between the support 57 and gown 12 across the support 57 near the upper and lower edges and parallel to the belt 16, as indicated in dotted lines in FIG. 5. The support 57 is preferably about 18 centimeters in the vertical direction by 23 centimeters in the horizontal direction.

It is preferred to use a belt 16 double stack folded as shown in FIG. 6, with the patch-type belt support 57. Stacks 68 and 70 are folded from the portions of the belt lateral to central portion 72. The central portion 72 is slightly shorter than the horizontal width of the patch-like support 57 and preferably is about 20 centimeters long. As they extend away from central portion 72, the inner fold lines 82 of stacks 68 and 70 converge toward each other, and outer fold lines 84 of the stacks also converge, in parallel to the inner edges 82, as shown in FIG. 6. Folds 74 extend outwardly and around, by fold lines 78 and 80, patch-like belt support 57. The folds 86 of each stack 68 or 70 are approximately 8 centimeters in length. Although an alternative belt end temporary attachment is shown in FIGS. 5 and 6 with the patch-type belt support 57, the belt end may be folded and attached in the way shown in FIGS. 1 through 4.

In the alternative belt attachment shown in FIGS. 5 and 6, the belt end 20' is attached to belt end 18' instead of belt support 57 by first folding belt end 18' against the face of the belt support 57 and then folding belt end 20' atop belt end 18' and attaching the belt end 20' to the belt end 18' as shown at attachment area 90. In this case, the belt end 20' is provided with a tear away extremity defined by a line of weakness which lies intermediate the attachment area 90 and the end edge of belt end 20'. This is similar to the arrangement described with reference to belt end 20 of FIGS. 1-4. Analogously, belt end 18' could also include a "folded under" weakened extremity and the belt end 20' attached to the "folded under" belt end 18', as before.

While particular embodiments of the present invention have been illustrated and described, it will be obvious to those skilled in the art that various changes and modifications can be made without departing from the spirit and scope of the invention and it is intended to cover, in the appended claims all such modifications that are within the scope of this invention.

What is claimed is:

1. In a belt package for a surgical gown, a belt having a belt end extending from a belt support, the extremity of said belt end being defined by a transverse region of weakness and separable from the balance of the belt therealong, said belt end being doubled by folding it back on itself along a fold line extending transversely across the balance of the belt in a position adjacent but spaced from said region of weakness, the doubled portion being folded inwardly to position said extremity, the region of weakness and the distal end of the balance of the belt over an outer face of said belt package and underlying an adjacent portion of the belt end, said distal end being detachably secured to said outer face of said belt package.

2. The belt package of claim 1 in which the location of said detachable securement of said distal end is spaced from said fold line.

3. The belt package of claim 2 in which said doubled portion is outwardly expandable while said distal end is detachably secured so as to permit a finger to be inserted between said double portion to detach said securement of said distal end.

4. The belt package of claim 1 in which said detachable securement is effected throughout a region of said distal end which excludes a pull tab area thereof contiguous to said fold line.

5. The belt package of claim 1 in which said belt support includes a tubular portion within which said belt is telescoped and a height adjustment/suspending strip adapted to fasten said tubular portion to a surgical gown.

6. The belt package of claim 5 in which said tubular portion and said height adjustment/suspending strip are integrally formed from one sheet of material.

7. The belt package of claim 3 in which the detachable securement of said distal end is with the outer face of the height adjustment/suspending strip.

8. The belt package of claim 1 in which said distal end is detachably secured by adhesive, detachment occuring between said adhesive and a fibrous nonwoven fabric region of said package so that fibers from said fabric region continue to adhere to said adhesive after detachment so as to neutralize said adhesive.

9. The belt package of claim 1 in which said belt support includes a fabric patch attached to said gown along spaced parallel lines so as to form a tunnel within which said belt is telescoped.

10. The belt package of claim 1 wherein both belt ends extend from a belt support and said distal end of one belt end is detachably secured to the outward face of the other belt end.

* * * * *

UNITED STATES PATENT AND TRADEMARK OFFICE

CERTIFICATE OF CORRECTION

PATENT NO. : 4,326,300

DATED : April 27, 1982

INVENTOR(S) : Deborah A. Bolton and Jean E. Schaefer

It is certified that error appears in the above-identified patent and that said Letters Patent are hereby corrected as shown below:

Column 1, line 46, "3,696,433" should read -- 3,696,443 --.

Signed and Sealed this

*Fifteenth* Day of *June 1982*

[SEAL]

*Attest:*

GERALD J. MOSSINGHOFF

*Attesting Officer*

*Commissioner of Patents and Trademarks*